United States Patent [19]

Christenson

[11] Patent Number: 4,641,835

[45] Date of Patent: Feb. 10, 1987

[54] CUSHION FOR A SWING OR THE LIKE AND METHOD FOR MAKING SAME

[75] Inventor: Robert J. Christenson, Flushing, Mich.

[73] Assignee: GMI Engineering & Management Institute, Flint, Mich.

[21] Appl. No.: 707,722

[22] Filed: Mar. 1, 1985

[51] Int. Cl.[4] ..... A63G 9/12

[52] U.S. Cl. ..... 272/87; 5/247; 114/219; 293/122

[58] Field of Search ..... 272/87, 85, 86, 88, 272/89, 90, 91, 92, 65; 267/140, 142, 143, 145, 131, 133; 114/219, 230; 293/122, 123; 5/247

[56] References Cited

U.S. PATENT DOCUMENTS

| | | | |
|---|---|---|---|
| 103,030 | 5/1870 | Duffy et al. | 5/247 X |
| 185,851 | 1/1877 | Cobb | 5/247 X |
| 1,839,656 | 1/1932 | Dorton | 5/247 X |
| 2,722,906 | 11/1955 | Tweddell | 114/219 |
| 3,130,998 | 4/1964 | Andersen | 293/123 |
| 3,432,200 | 3/1969 | Barton | 293/122 |
| 3,638,985 | 2/1972 | Barton et al. | 293/122 |
| 3,843,182 | 10/1974 | Walls et al. | 293/122 |
| 4,227,832 | 10/1980 | Leone et al. | 114/219 X |
| 4,281,610 | 8/1981 | Young | 114/219 |
| 4,408,790 | 10/1983 | Shimoda et al. | 293/122 |

OTHER PUBLICATIONS

Rainy-Day Swing, Popular Mechanics, Dec. 1960, p. 175.

*Primary Examiner*—Robert A. Hafer
*Assistant Examiner*—Arnold W. Kramer
*Attorney, Agent, or Firm*—Burton, Parker & Schramm

[57] ABSTRACT

An elastic cushion formed of a elastic cushion tube and a supporting frame. The cushion tube is slit axially to create a pair of slit edges which are elastically expanded to create a cushion tube of C-shaped cross section. The slit edges of the cushion tube are retained in a pair of spaced-apart axial grooves formed in the frame member so that the cushion tube will elastically deform when loaded in a region generally opposite the expanded slit.

16 Claims, 3 Drawing Figures

FIG.1
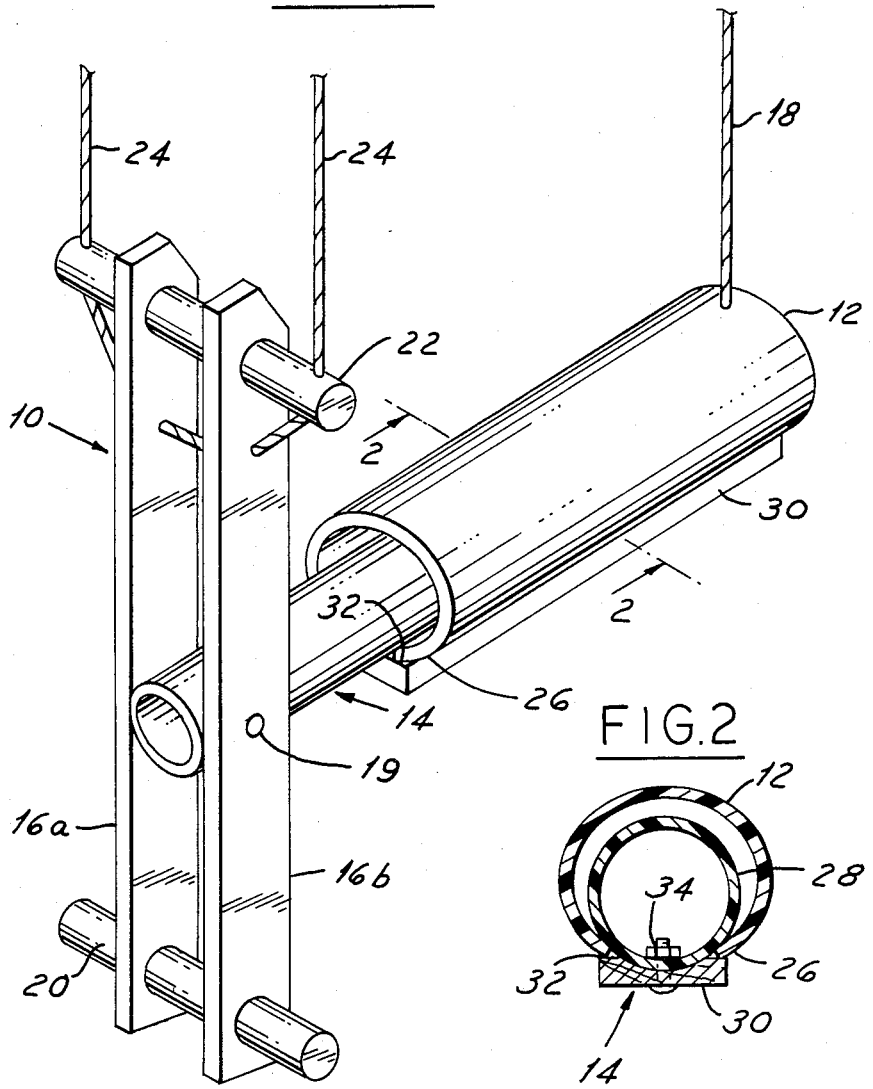
FIG.2
FIG.3
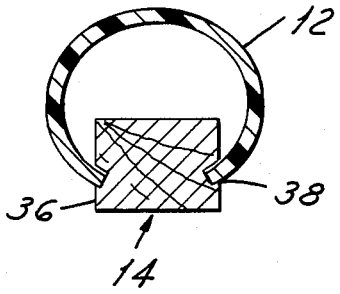

CUSHION FOR A SWING OR THE LIKE AND METHOD FOR MAKING SAME

FIELD OF THE INVENTION

This invention relates to the field of elastic cushions useful for swings and a wide variety of other apparatus and more particularly to elastic cushions formed of a tube having a C-shaped cross section.

BACKGROUND OF INVENTION

Elastic cushions are employed in a wide variety of devices from seats for children's toys to dock fenders. In the fabrication of children's toys, particularly those having a straddle type seat, it is desirable to have a reasonably inexpensive elastic seat which is adjustable to accommodate various size users. Children's swings employing staddle type seats are shown in U.S. Pat. Nos. 3,391,932 and 3,684,282. The seats are adjustable for and aft and may be padded or upholstered to make them more comfortable. The fabrication of the comfortable padded seat is a significant portion of the cost of fabricating children's toy and it was an object of the present invention to develop an inexpensive alternative seat design which could be used by a wide range of different size persons without the necessity for seat adjustment in a straddle type swing.

The elastic cushion which is the object of this invention is useful in countless situations and it is not limited merely to show children's toys. Elastic cushions are useful in dock fenders as shown in U.S. Pat. No. 3,197,189—Pemper, as used, in truck loading dock and marine situations. The dock fender of Pemper is formed of a elastic-closed tubular section having a flat surface providing one side wall and an oppositely disposed curvilinear-shaped contact surface. Another prior art elastic cushion is shown in U.S. Pat. No. 3,130,998—Anderson, where an auto bumper formed of a pair of elastic tubes of different diameter located one inside the other along the common vertical line. The tubes are riveted or otherwise mechanically fastened to a support bracket attached to the vehicle along the line of tangency. The enclosed tube elastically deforms when loaded on the side generally opposite that of the point of attachment to the vehicle.

SUMMARY OF INVENTION

I have discovered an elastic cushion useful for a swing or the like and a method of making same which is very inexpensive to manufacture and quite durable. My elastic cushion is formed of a cylindrical cushion tube which has an axial slit extending the entire length of the peripheral wall, to form a pair of slit edges. The cushioned tube slit edges are elastically expanded to create a C-shaped cross section and the cushion tube attachs to a supporting member along the slit edges. When the cushion tube is loaded on the side of its peripheral wall generally opposite of that of the slit and the accompanying supporting member, the tube wall elastically deforms to provide a resilient cushion. The tube can be supported by a frame member which is provided with a pair of spaced-apart axial grooves for receiving the slit edges of the cylindrical cushion tube.

BRIEF DESCRIPTION OF THE DRAWINGS

FIG. 1 is a perspective view of a children's straddle swing employing my novel cushion design;

FIG. 2 is a cross sectional view taken along line 2—2 of FIG. 1 showing a cross section of the cushion portion of the swing; and FIG. 3 is a cross sectional view of an alternative embodiment of the elastic cushion employing a different means for supporting the cushion tube.

BRIEF DESCRIPTION OF THE PREFERRED EMBODIMENT

Referring to the drawings, a straddle-type children's swing 10 is shown employing a elastic cushion seat. The swing is generally comprised of a cushion tube 12 attached to a horizontal frame 14. Frame 14 has two ends, a front end attached to links **16*a* and 16*b* and a rear end attached to the tensile member 18. Links 16*a* and 16*b* are centrally pivotally attached to horizontal frame 14 by pivot 19, and they are provided with an interconnecting footrest 20 at the lower end and a handle 22 at the upper end. Links 16*a* and 16*b* are connected to tensile members 24 which, like tensile member 18, may be attached to a overhead support structure for the suspension of the swing. The user sits on the cushion tube 12** which provides an elastic seat and places his/her feet on the footrest and hands on the handle. Movement of the hands and feet in an opposite but alternating push/pull manner will result in the for and aft oscillation of the swing. A short user will sit on the front portion of the cushion tube, while a taller user will sit on the portion of the cushion tube to the rear of the swing without necessitating any seat adjustment.

FIG. 2 shows a cross section of the elastic cushion and accompanying horizontal frame member employed in the swing in FIG. 1. The cushion tube 12, as shown, has a generally C-shaped cross section. Cushion tube 12 may be formed by axially slitting the peripheral wall of a cylindrical tube such as a plastic PVC pipe and elastically expanding the slit to create a C-shaped cross section. A horizontal frame member of 14 provides a means for supporting the cushion tube in the C-shape position. When the cushion tube is loaded on the side that is generally opposite the opening of the C-shape, the cushion tube elastically deforms. The cushion tube can be retained by the horizontal frame member without need for fasteners since the cylindrical cushion tube wants to return to its original circular configuration. The edges of the cushion tube forming the slit are received in spaced-apart and axial grooves formed in the frame. In the embodiment of the invention shown in FIG. 2 the frame is comprised of a support tube 28 and the retainer strip 30 attached to the periphery parallel thereto. The junction of the retainer strip to the support tube form a pair of parallel spaced-apart axial grooves 32 for receiving the slit edges of the cushion tube. The retainer strip is attached to the support tube using conventional means such as the nut and bolt shown. Preferably, a groove is formed in the retainer strip to match the contour of the support tube so that the two parts may be more securely fastened together.

The cushion tube and the support tube employed in the embodiment shown in FIG. 2 may be formed of conventional PVC pipe used in the construction industry. The cushion tube and the support tube may originally be the same diameter since the effective diameter of the cushion tube increases as the result of the expanding of the slit formed in the peripheral wall. The cushion tube once slit and expanded into the C-shaped cross section as shown becomes much more elastic than the original uncut tube section. As shown in FIG. 2 a crescent-shaped region is defined by the area bounded by the internal wall of the cushion tube 12 and the outside periphery of support tube 28. As cushion tube 12 is loaded, the portion of the cushion tube in the region of loading will be deflected toward the support tube 28. If the elastic cushion is loaded enough to cause cushion tube 12 to engage support tube 28, the elasticity of the cushion will be dramatically reduced and will also serve as a means of preventing the cushion tube from being overloaded. Retainer strip 30 may axially extend the entire length of cushion tube 12 or may be merely located at intermittent points along the tube. If the retainer strip is located the entire length of the cushion tube, the retainer will also add structure to the frame. The retainer strip may be made of wood or any suitable easily formed material.

An alternative embodiment of the elastic cushion is shown in FIG. 3. Rather than using a frame formed of a plastic tube and retainer strip, the embodiment of the invention shown in FIG. 3 uses a wooden frame member in which a pair of spaced-apart axial grooves are machined for receiving the slit edges of the cushion tube. Preferably, the axial grooves formed in frame member 36 will correspond in orientation to the angle of the tube wall forming the slit and edge as it engages the frame member. It is also preferable for the axial groove to be slightly wider than the cylindrical tube wall thickness to allow movement therebetween as the tube deflects when loaded.

It is envisioned that this elastic cushion is not merely limited to use with a swing but many provide an elastic cushion for a whole variety of situations where a durable, inexpensive cushion is desired. Similarly, the cushion need not be horizontally located but may be located vertically as would be the case if attached to a piling. Furthermore, the frame which provides a means for supporting the tube may be incorporated as part of a piling or other object the cushion is to be affixed to.

In addition to being very durable, one of the principal advantages of the elastic cushion is the ease and simplicity by which it may be manufactured. The cushion may be formed by forming an axial slit in a cylindrical tube to create a pair of slit edges. The slit edges are then expanded elastically to create a generally C-shaped cross section. The slit edges are then inserted into a pair of axial spaced-apart slots formed in a supporting means so that when the tube wall in the region generally opposite the slit is loaded, the tube elastically deforms.

It will be understood, of course, that while the forms of this invention herein shown and described constitute preferred embodiments in the invention, it is not intended to illustrate all the possible forms of the invention. It will be also understood that the words used are words of description rather than limitation and that various changes may be made without departing from the spirit and scope of the invention herein disclosed.

I claim:

1. An elastic cushion comprising:

a cylindrical resilient cushion tube having a peripheral wall, with an axial slit extending the length thereof, creating a pair of slit edges in said wall; and groove means for supporting said cushion tube, said groove means being spaced apart axial grooves for receiving said edges of said slit and holding said edges of said slit a spaced distance apart with the orientation of said grooves corresponding to the natural angle of the tube wall forming the slit and edge so as to elastically expand said tube cross section into a "C" shape;

wherein, said cushion tube is loaded on a portion of the peripheral wall oppositely disposed from said slit, the cushion tube wall being elastically deformable to provide a resilient cushion.

2. The invention of claim 1 wherein said groove means for supporting said cushion tube further comprises:

a frame extending the length of the cushion tube provided with said spaced apart axial grooves for receiving said slit edges.

3. The invention of claim 2 wherein said cushion tube elastically resists the expansion causing said slit edges when received in said grooves to be biased towards each other in the attempt of the cushion tube to return to its original cylindrical configuration thereby securely attaching the cushion tube to the frame.

4. The invention of claim 3 wherein said frame further comprises a tubular support and a retainer strip attached to the periphery of the tubular support and extending the length thereof, wherein said axial grooves for receiving the slit edges are formed by the junction of the tubular support and retainer strip.

5. The invention of claim 4 wherein said retainer strip is further provided with a groove formed therein to engage an axial strip of tubular support periphery.

6. The invention of claim 5 wherein said tubular support is located generally within the interior region of said cushion to define a crescent-shaped cushion region having a convex portion bounded by the cushion tube wall and a concave portion bounded by said tubular support.

7. The invention of claim 2 wherein said cushion tube is formed of a plastic material.

8. The invention of claim 7 wherein said tubular support is formed of a plastic material.

9. The invention of claim 8 wherein said cushion tube and said tubular support are formed of PVC pipe.

10. The invention of claim 7 wherein said frame further comprises an elongated wooden support with said spaced-apart axial grooves cut therein in the region of the cushion tube.

11. A swing having an elastic cushion providing a seat for the user comprising in combination:

a generally horizontal frame member having a first and second end;

a cylindrical cushion tube having a peripheral wall with an axial slit formed therein extending the length of the tube creating a pair of slit edges; groove means for supporting said cushion tube on said frame member, said groove means being spaced apart axial grooves for receiving said edges of said slit and holding said edges of said slit a spaced distance apart with the orientation of said grooves corresponding to the natural angle of the tube wall forming the slit and edge so as to elastically expand said tube cross section into a "C" shape;

a link having two ends centrally pivotably attached to one end of said frame, said line and said frame lying in a common generally vertical plane;

a foot rest attached to one end of the link below the axis of the frame;

a handle attached to the other end of said link generally above the axis of the frame;

a tensil member attached to said link for pivotably supporting same beneath an overhead support;

a tensil member for attachment to the end of the frame opposite said link for pivotably supporting same beneath the overhead support wherein said user sits on said tube which provides an elastic cushion seat and places his/her hands and feet on said handle and footrest to oscillate said swing.

12. The invention of claim 11 wherein said cushion tube is formed of plastic material.

13. The invention of claim 12 wherein said horizontal frame member is further provided with a pair of said spaced-apart axial grooves for receiving said slit edges of the cushion tube.

14. The invention of claim 13 wherein said frame further comprises a tubular support in a retainer strip attached to the periphery of the tubular support and extending parallel thereto, wherein said axial grooves for receiving the slit edges of the cushion tube are formed by the junction of the tubular support and the retainer strip.

15. The invention of claim 14 wherein said tubular support is formed of a plastic material.

16. A method of forming an elastic cushion comprising the following steps:

forming a pair of parallel spaced-apart axial grooves in a frame member facing outwardly in substantially the direction of the circumference of a cylinder;

slitting a cylindrical resilient cushion tube axially;

elastically separating the slit edges of the cushion tube to create a "C"-shaped cross section; and attaching the cushion tube to the frame by placing the slit edges of the cushion tube in the axial grooves in the frame which maintains the elastic separation of the slit edges and so retains the cushion tube on the frame and so allows the cushion tube to be resiliently deformed when loaded on the portion of the tube periphery generally opposite the slit.

* * * * *